United States Patent [19]

Andreasen

[11] 4,249,767

[45] Feb. 10, 1981

[54] PORTABLE TOOLS FOR REMOVING SNOW FROM PITCHED ROOFS

[76] Inventor: Norman H. Andreasen, 3885 Gregory Dr., Northbrook, Ill. 60062

[21] Appl. No.: 69,877

[22] Filed: Aug. 27, 1979

[51] Int. Cl.[3] ..... E01H 5/02; A47L 13/02

[52] U.S. Cl. ..... 294/19 R; 294/54; 37/53

[58] Field of Search ..... 294/19 R, 54, 1 R, 49, 294/58; 37/53, 115; 15/236 R

[56] References Cited

U.S. PATENT DOCUMENTS

| | | | |
|---|---|---|---|
| 3,091,790 | 6/1963 | Schroeder | 37/53 |
| 3,483,643 | 12/1969 | Wenzel | 294/54 |
| 4,024,654 | 5/1977 | Snyder | 37/53 |

*Primary Examiner*—James B. Marbert

*Attorney, Agent, or Firm*—J. Robert Cassidy

[57] ABSTRACT

A portable tool suitable for removing snow accumulations from pitched roofs while standing on the ground. The tool is provided with an elongate handle for propelling a U-shaped body member upwardly across the roof while forming a U-shaped channel in the snow, and a pivotal blade movable into a plane generally perpendicular to the roof upon movement of the tool downwardly toward the roof edge for plowing the snow in the previously formed U-shaped channel off the roof.

6 Claims, 16 Drawing Figures

20
41a
32
41
43
42
44
45
50a
50b
50c
50d
50n
39
39a
48
49
31
24
35
29
30
34
56(58)
59
50
52(54)
69(70)
64
72L(72R)
60L(60R)
61
56
99
52
98
88
89
79
85
86
82
76
75
80
84
90
58
92
91
60
72
94

50
51
52
54
55
56
58
59
60R
60L
61
62
64
65
66
68
69
70
71
72R
72L
24
35
41

PORTABLE TOOLS FOR REMOVING SNOW FROM PITCHED ROOFS

BACKGROUND OF THE INVENTION

The present invention relates generally to hand-held apparatus suitable for use in facilitating removal of snow from snow-laden roofs; and, more particularly, to an apparatus suitable for use in removing snow from pitched roofs. While apparatus made in accordance with the present invention can be utilized for snow removal purposes with a variety of building types—e.g., shingles, tiles, slate, galvanized and other types of roofing materials—it will become apparent as the ensuing description proceeds that the invention finds particularly advantageous use in the removal of snow from pitched roofs of single story buildings while permitting the operator to remain on the ground.

During recent years, wide areas of the world have been subjected to winters of increasing severity in terms of both temperature conditions and snow accumulations. At the same time, more and more homes have been constructed to accept increasing population and shifting population centers; and, in large part, such homes have been of the single story ranch type or of the split level variety where at least a portion of the building is only one story high.

In those areas where weather conditions are such that relatively significant snow storms occur accompanied by periods of sub-freezing temperatures, residents, users, and/or owners of such buildings have experienced serious damage, not only to the roofs as such, but also to internal walls, ceilings and personal property, all as a result of snow accumulations on the roofs. As a practical matter, damage can result from either excess loading of the roof or as a result of periodic melting and freezing of the snow. In the former case, a single major snow storm or a series of lesser storms result in snow accumulations of increasing depth, particularly in localized areas on a roof as a result of drifting; and, where the load limits for the roof are exceeded, structural damage occurs that generally results in leaks and which can result in failure and collapse of all or a portion of the roof. In those instances where the building is a barn, chicken coop, or similar farm-type building, such structural failures and collapse often result in loss of life of livestock and/or other animals housed therein.

In the latter case, since roofs are not perfect heat insulators, that portion of the snow accumulation immediately adjacent the roof of a heated building tends to melt and the water thus formed flows downwardly to the gutter located at the outer periphery of the roof in the area of the overhanging eaves—viz., generally an area which is not subjected to heat loss from the building. As a consequence, the water collected in the gutter and downspouts tends to freeze and soon forms an ice dam or barrier which prevents flow of water from melting snow through the gutters and downspouts. Consequently, as snow continues to melt and form water, both as a result of heat escaping through the roof, action of the sun, daytime conditions of above freezing temperatures alternating with nighttime conditions of sub-freezing temperatures, and during periods of general thawing, such water tends to accumulate behind the ice barrier on the surface of the roof and to seep upwardly under the shingles, tiles, or other roofing materials. This condition often results in serious internal structural and cosmetic damage to the building and, on many occasions, to personal contents of the building.

Expensive and elaborate heating systems have been developed in an effort to eliminate, or at least minimize, the damage resulting from the build-up of ice barriers in gutters and downspouts. These generally consist of electric coils which are placed in the gutters and downspouts for the purpose of generating heat and thus preventing the formation of an ice barrier. However, such systems have not provided a solution to the problem. First, they tend to utilize relatively large amounts of electrical energy, a commodity of increasing value in a society that has become increasingly aware of the need to conserve energy in every possible way. Moreover, in many cases such devices are ineffective because of temperature conditions, and such ice barriers form despite the presence of the electrical coil—for example, in conditions where the roof is poorly insulated and temperatures range well below freezing and often below zero for prolonged periods of time. And, of course, in severe weather conditions it is not unusual for individual buildings and/or entire areas to experience power outages, at which time such heat generating coils are rendered useless. Finally, such devices are, even when operating at peak efficiency, totally incapable of minimizing the effect of either local or general overloading of a roof or a portion thereof due to areas of accumulated snow which can, and often do, extend several feet in depth, particularly where drifting has occurred.

The only recognized and foolproof solution to the problem has been to remove the snow from the roof, a process that generally has required shovelling. Not only is this a task which requires strenuous effort, often leading to heart attacks or other physical disabilities, but, moreover, it is highly dangerous since the shoveller, to be effective, must ascend to the roof and shovel snow while walking about on a pitched slippery surface. In addition, under the adverse weather conditions, shingles and tiles tend to be quite brittle as a result of both ice accumulation and low temperatures, and consequently they tend to break when subjected to additional loading resulting from the weight of a person walking or sliding on the roof. Such breakage of roofing materials can, and often does, lead to further leakage problems. Moreover, if the accumulating snow is not removed properly, ice barriers tend to form rapidly, and as a result, it has been found necessary to mechanically remove the ice from gutters and overhanging eaves, generally by the use of hammers, chisels, ice picks and other tools which must be manipulated by an individual standing on a ladder. Not only is this a dangerous procedure that can result in serious injury should a ladder slip or should the tool being utilized carom off the ice when a blow is struck, but it can also result in structural damage to both the roof and the gutter.

It is a general object of the present invention to provide simple, economical, and safe tools for facilitating the removal of snow from a building roof, and which can be utilized not only by adult males, but also by women and children.

Another object of the invention is to provide a lightweight versatile tool that can be utilized to remove snow accumulations of varying depths from a building roof, both during and immediately following a snow storm before the formation of ice barriers, and thus to eliminate the need for expensive energy-consuming devices in gutters.

In another of its important aspects, it is an object of the invention to provide a novel ground-operated snow removal tool for use on pitched roofs which avoids the necessity to use ladders and/or to stand and walk on such roofs.

These and other objects and advantages of the present invention will become more readily apparent upon reading the following detailed description and upon reference to the attached drawings in which.

Figure 4:
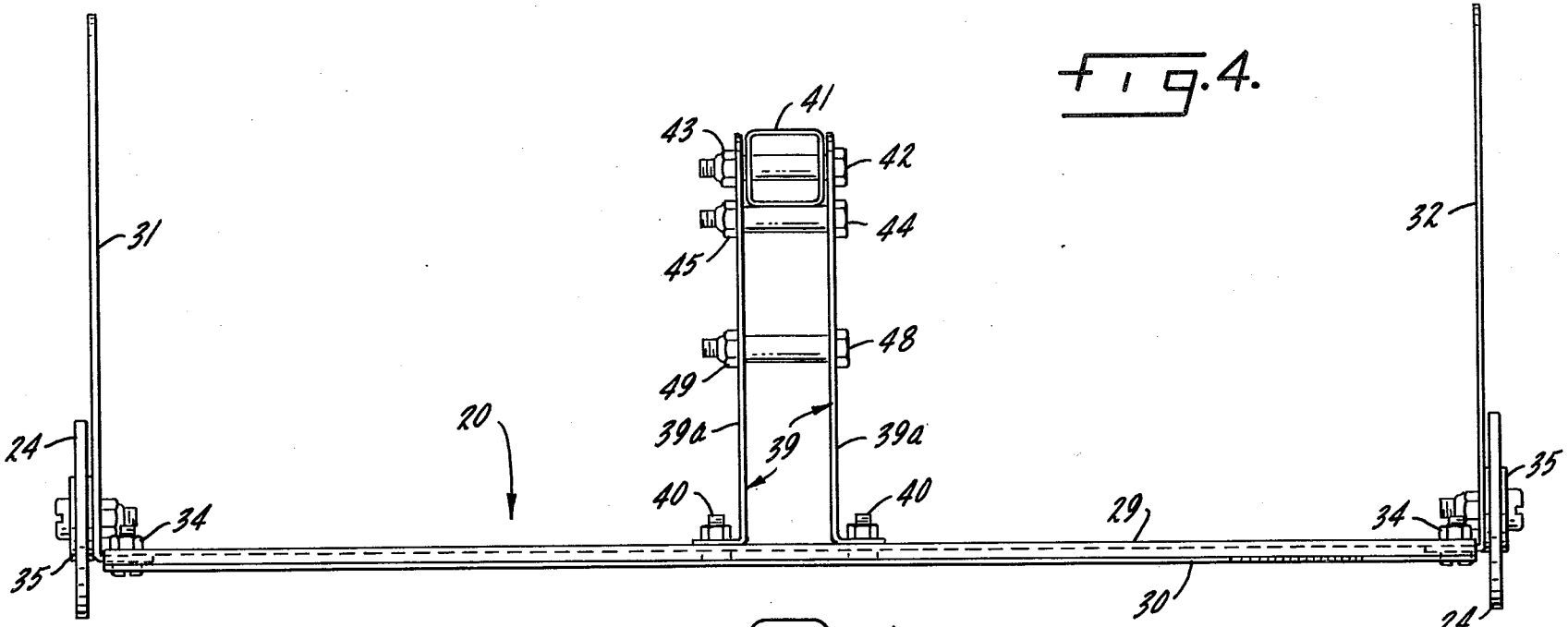
FIG. 4 is a front elevational view of the snow removal tool shown by way of example in FIGS. 1 and 2.
Figure 5:
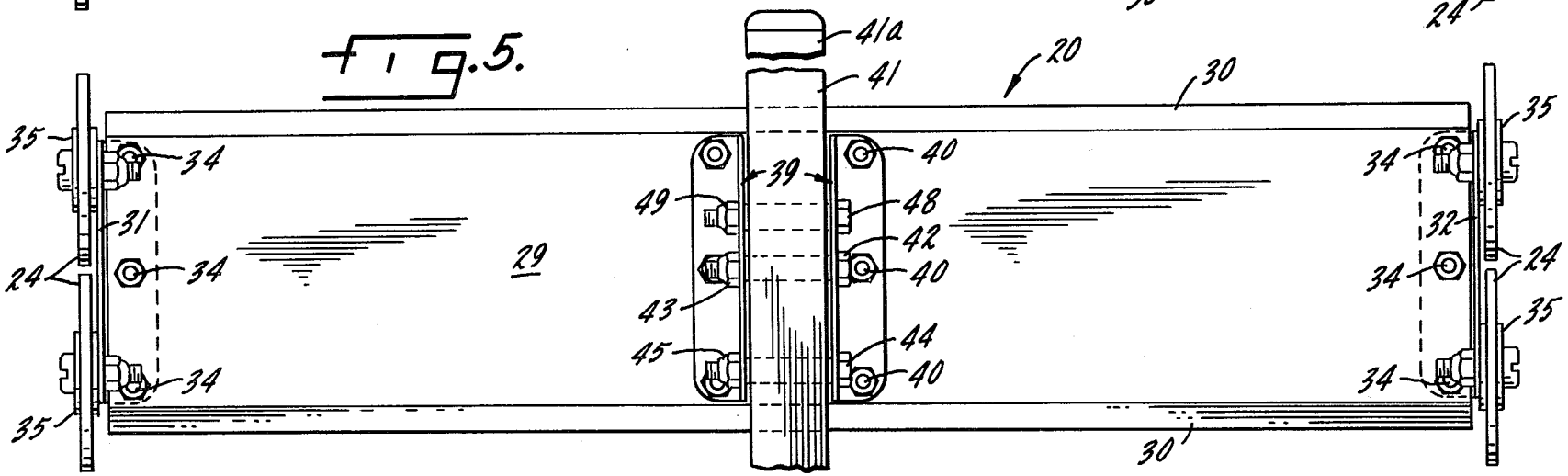
FIG. 5 is a plan view of the snow removal tool of FIG. 4.
Figures 6, 9, 12, 15, 16:
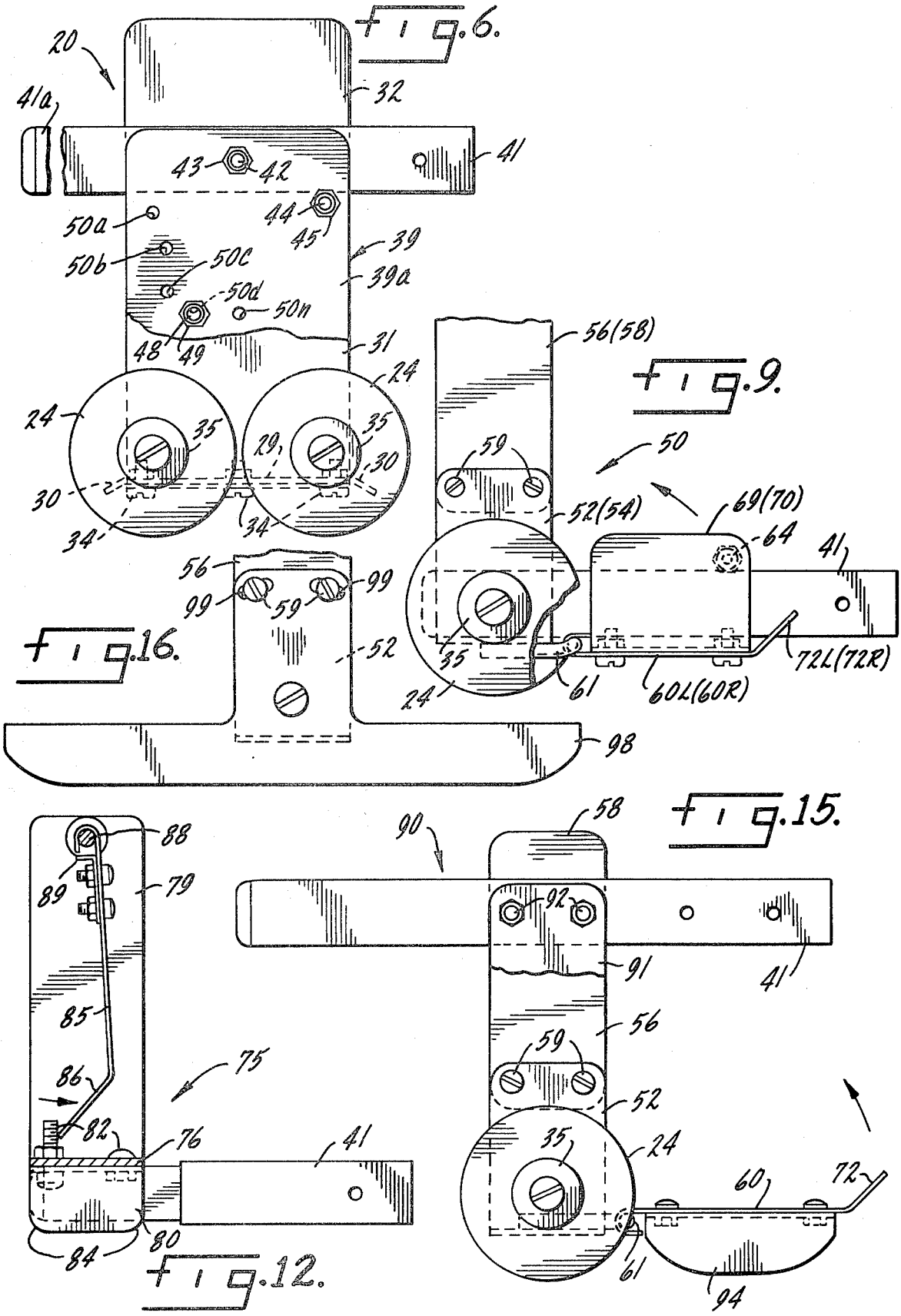
FIG. 6 is a side elevational view of the tool shown in FIGS. 4 and 5.
FIGS. 7, 8 and 9 are, respectively, front, plan and side elevational views similar to FIGS. 4, 5 and 6, but here depicting a modified type of snow removal tool also embodying the features of the present invention.
FIGS. 10, 11 and 12 are, respectively, front, plan and side elevational views similar to FIGS. 4, 5 and 6, here illustrating another modified embodiment of the present invention.
Figures 13, 14:
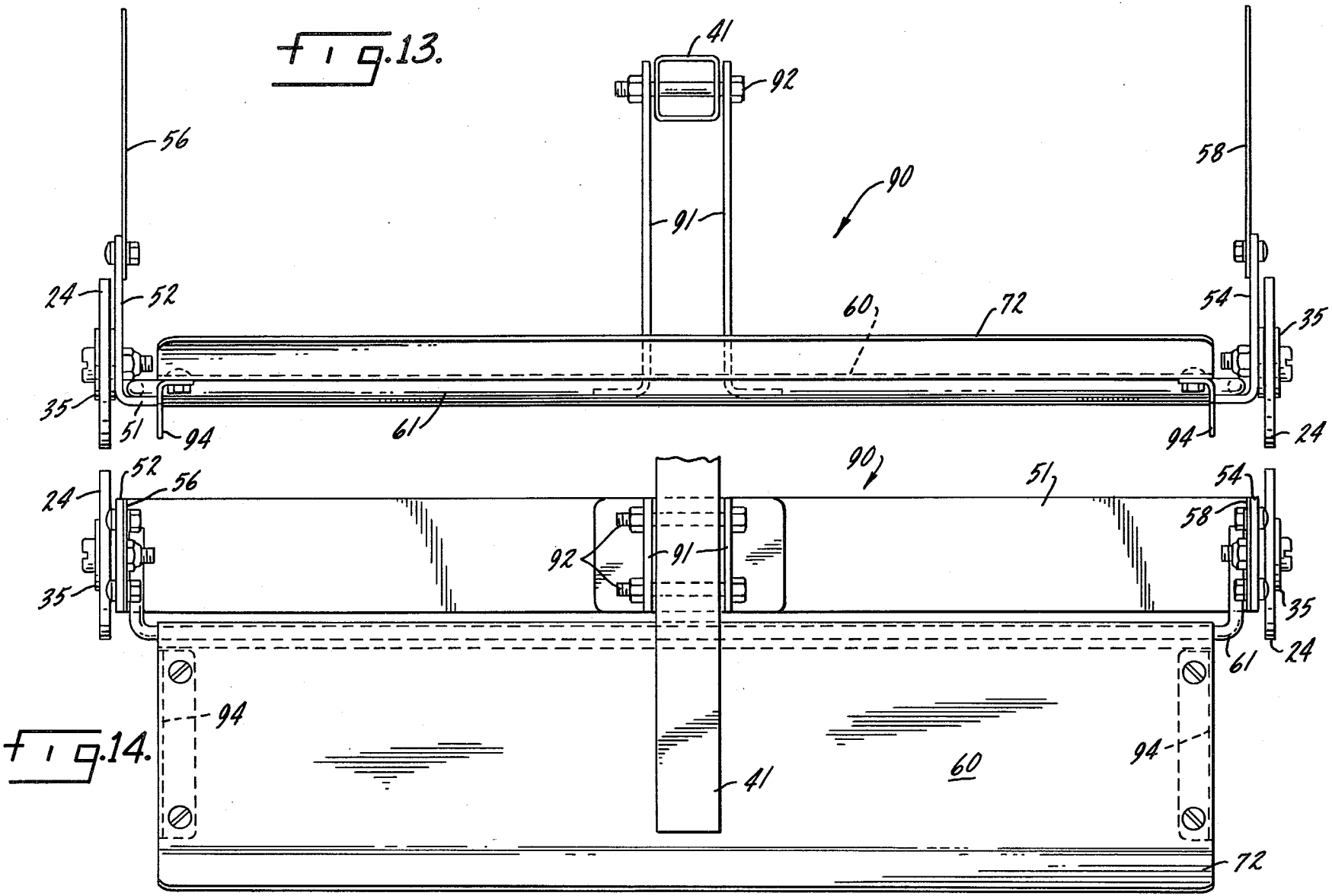

FIGS. 13, 14 and 15 are, respectively, front, plan and side elevational views similar to FIGS. 4, 5 and 6, depicting yet another modified form of snow removing tool embodying the features of the present invention; and, FIG. 16 is a fragmentary side elevational view, here illustrating a modified form of roof engaging skid which finds particularly advantageous use when the roof being cleared is formed of relatively thick shingles or tiles whose leading edges present an impediment to smooth upward movement of wheeled snow removal tools.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

THE ENVIRONMENT OF THE INVENTION

Figure 1:
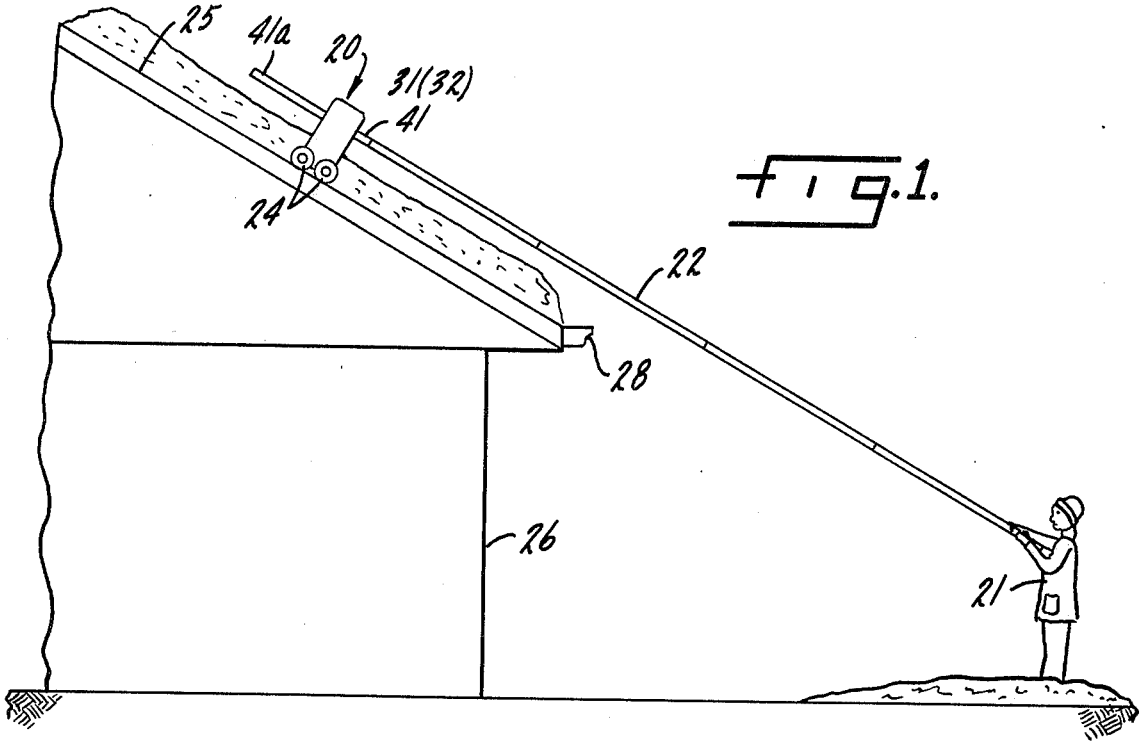
FIG. 1 is a schematic side elevational view here illustrating the use of a tool made in accordance with one of the embodiments of the present invention for removing snow accumulations from a pitched roof while operating the tool from the ground.

Referring first to FIG. 1, there has been illustrated an exemplary snow removing tool, generally indicated at 20, embodying features of the present invention, such tool here being operated by a remotely located individual 21 from ground level. As here shown, the tool 20 is mounted at one end of an elongate rod or pole-type handle 22 which can take the form of a collapsible telescoping rod or tube of the type conventionally employed for various other uses such, for example, as tree-pruning equipment or tools utilized to clean swimming pools. The tool 20 is provided with roof-engaging means which may, but need not, take the form of wheels 24 for traversing the pitched roof 25 of a building 26 in directions generally perpendicular to the gutter 28.

Referring to FIGS. 4, 5 and 6 conjointly, it will be observed that the exemplary snow removal tool made in accordance with this form of the invention comprises an elongate flat blade 29 which may, for example, vary in length, width and thickness. While the particular dimensions selected are not critical, I have found that excellent results can be achieved with blades on the order of 18 inches to 24 inches in length and 4 inches to 8 inches in width. The thickness of the blade may vary considerably depending upon the material from which it is made and its overall length, it being necessary only that the blade have sufficient structural integrity to withstand bending forces incurred during use of the tool to remove snow accumulations from the roof 25. The leading and trailing edges of the blade 29 may be bent slightly, as best indicated at 30 in FIG. 6, to both improve the structural integrity of the blade and to facilitate movement thereof through snow accumulations by formation of a channel in the snow somewhat deeper than the blade thickness.

In carrying out the present invention, the tool is preferably provided with a pair of vertically oriented blades 31, 32 which are respectively secured to the outboard ends of blade 29 by means of threaded fasteners 34 or other suitable fastening members (not shown). The arrangement is such that the blades 29, 31, 32 define a U-shaped blade or body member (as best viewed in FIG. 4) which, when propelled through the snow with the blade 29 parallel to the roof as shown in FIG. 1, forms a U-shaped channel in the accumulated snow. To facilitate movement of the tool 20 over the roof, one or more pairs of wheels 24 are journaled in bearings 35 mounted in the upstanding blades 31, 32 and positioned so as to insure that blade 29 moves over the roof 25 in closely spaced relation thereto. As viewed in the right hand portion of FIG. 2, it will be observed that during upward movement of the tool 20 over the roof 25 as the operator pushes on handle 22, both pairs of wheels 24 engage the roof surface and enable the blade 29 to easily and smoothly traverse the roof without impingement against, or damage to, the leading edges 36 of shingles or tiles 38. Moreover, it will be apparent that as the tool 20 moves upwardly over the roof 25 and through the snow (not shown in FIG. 2), the presence of the two vertical blades 31, 32 serve to cut a U-shaped channel through the snow which facilitates subsequent removal of the body of the snow within that channel in a manner described below.

In accordance with one of the important aspects of the present invention, the snow removing tool 20 is provided with a pivotally mounted member which, during upward movement of the tool (i.e., as shown in FIG. 1 and the right hand portion of FIG. 2), is maintained parallel to the roof 25 so as to permit the member to easily cut through the accumulated snow without dislodging the snow, yet it is readily pivotable to a position generally perpendicular to the roof surface during downward movement of the tool, at which time the pivotal member functions as a plow or hoe to remove the snow in the U-shaped channel previously formed. In carrying out the illustrative form of the invention shown in FIGS. 1, 2 and 4–6, this is accomplished by pivotally mounting the elongate flat blade 29 to the handle 22. To this end, a pair of spaced apart L-shaped flanges 39 are secured to the blade 29 as indicated at 40 with the long legs 39*a* of the flanges lying in vertical planes parallel to and mid-way between the vertical blades 31, 32. A hollow tubular handle-receiving receptacle 41 is pivotally mounted between the upper ends of the two spaced apart L-shaped flanges 39 by means of a bolt 42 and nut 43. A second bolt 44 and nut 45 combination provides a fixed stop positioned to engage the underside of handle-receptacle 41 and to prevent counterclockwise rotation of the tool 20 about the axis of bolt 42 (as viewed in FIG. 6) during upward movement of the tool over the roof.

In operation, the operator-held handle 22 (FIGS. 1 and 2) is mounted in telescopic relation to the handle-receiving receptacle 41 and secured in place by any suitable means such as a cotter pin, bolt, or other suitable means generally indicated at 46. The arrangement is such that as the operator pushes handle 22 upwardly (i.e., to the left as viewed in the right hand half of FIG. 2), the tendency of the tool 20 to rotate in a counterclockwise direction about the axis of bolt 42 is resisted by engagement of stop 44 and the handle-receiving receptacle 41 which is maintained generally parallel to the roof by handle 22. When the operator is ready to retract the tool 20, downward pressure exerted on handle 22 (i.e., in the direction of the arrow in the left hand portion of FIG. 2) causes the tool 20 to pivot in a clockwise direction as viewed in FIG. 2 about the axis of bolt 42, thus pivoting blade 29 from a plane generally parallel to the roof 25 to a plane generally perpendicular to the roof. The degree of pivotal movement permitted is controlled by an adjustable stop formed by a third bolt 48 and nut 49 combination which may be mounted in any one of several selectable positions 50*a*–50*n* in the L-shaped flanges 39.

Figure 2:
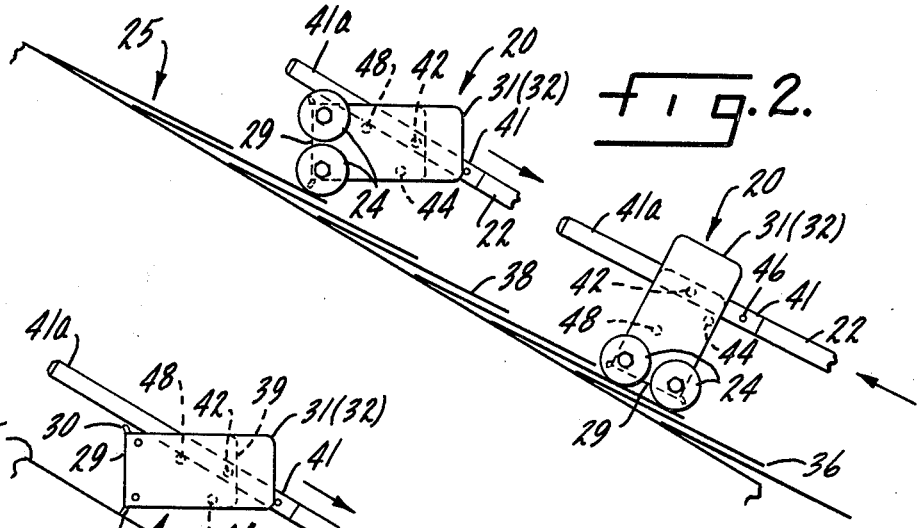
FIG. 2 is an enlarged schematic detail and side elevational view demonstrating the sequence of motions for the form of tool of the present invention shown in FIG. 1, the tool here being operated on a shingled or tiled roof.

As a consequence of the foregoing construction, as the operator pulls downwardly on handle 22 as indicated in the left half of FIG. 2, the tool 20 pivots clockwise about the axis of bolt 42 until engagement of the adjustable stop 48 with the handle receptacle 41. Continued downward movement of the handle 22 causes the now vertically disposed blade 29 to function as a hoe or plow which serves to propel the snow in the previously cut U-shaped channel downwardly off the roof and onto the ground. The operator then merely moves the tool laterally and repeats the foregoing process to remove adjacent U-shaped areas of snow from the roof. Moreover, because of the provision of the adjustable stop 48, the operator may readily adjust the tool so that the blade 29 will pivot to the optimum plowing position which will, of course, vary dependent upon the pitch of the roof.

In carrying out the invention, the handle receptacle 41 on the tool 20 may, if desired, be provided with a forward projecting portion 41*a* positioned so as to engage the gutter 28 should the operator inadvertantly pull handle 22 down too far so that the tool 20 is disengaged from the roof. This serves to prevent the tool from falling to the ground before the operator has finished removing snow from the roof.

Figure 3:
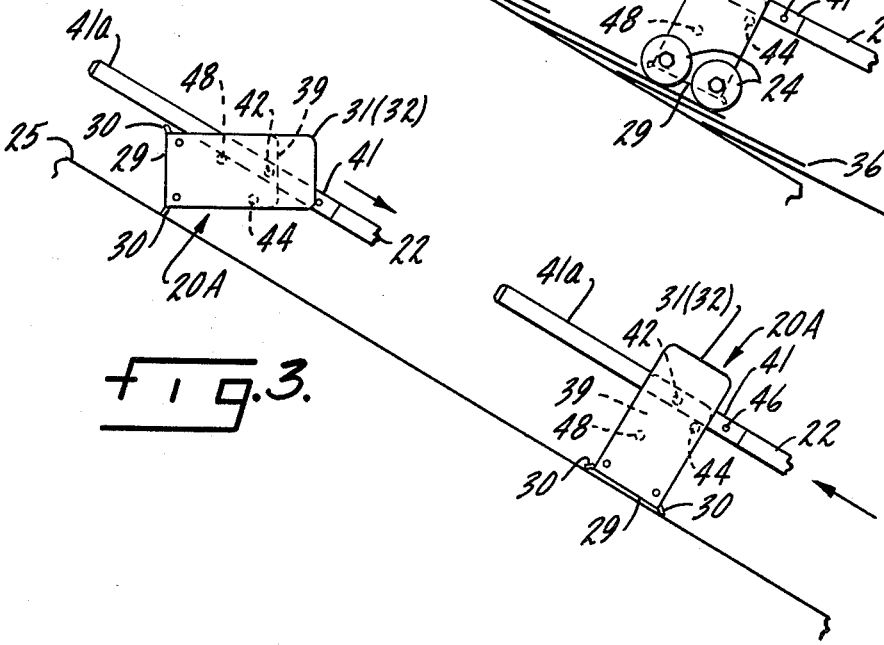
FIG. 3 is an enlarged schematic detailed and side elevational view similar to FIG. 2, but here depicting an alternative embodiment of the invention which is particularly suitable for use on pitched roofs formed of sheet material such as galvanized metal.

Turning to FIG. 3, it will be observed that a modified tool 20A has been disclosed which is identical in all respects to the tool 20 described above and shown in FIGS. 1, 2 and 4–6, except that the tool 20A is not provided with wheels. Rather, the angled edges 30 on blade 29 engage roof 25 directly. This form of the invention is particularly suitable for removing snow from smooth surfaced roofs such as those made of galvanized sheet metal where it is not necessary to take precautions to prevent impingement of the blade 29 against the leading exposed edges of shingles or the like such as shown in FIG. 2.

Figures 7, 8:
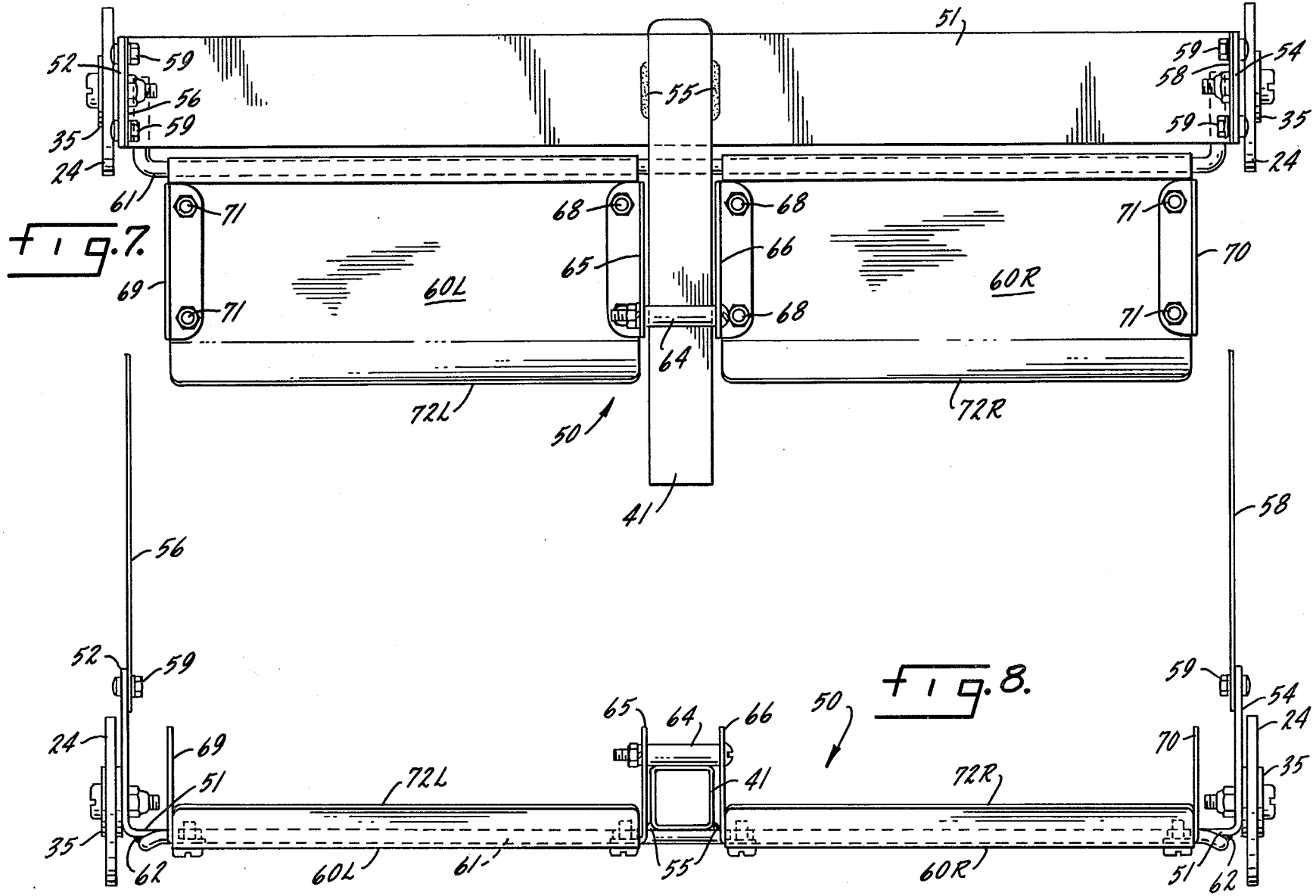

Referring to FIGS. 7, 8 and 9 conjointly, there has been illustrated a modified tool, generally indicated at 50, also embodying the features of the present invention. In keeping with this form of the invention, the handle-receiving receptacle 41 is fixedly mounted on the tool; for example, by welding the receptacle 41 to the center of the elongated flat blade 51 having vertical upstanding flanges 52, 54 at its opposite ends, such weld being indicated generally at 55 in FIGS. 7 and 8. In this space, a single pair of wheels 24 are mounted on the upstanding vertical flanges 52, 54 in suitable bearings 35. Vertical blades 56, 58 are rigidly secured to flanges 52, 54 by means of suitable threaded fasteners, generally indicated at 59. The arrangement is such that the blade 51, flanges 52, 54, and vertical blades 56, 58 define a U-shaped body member similar to that previously described in connection with the form of the invention shown described in connection with the form of the invention shown in FIGS. 1, 2 and 4–6.

In carrying out this form of the invention, a pair of blades 60L and 60R are pivotally mounted on a rod 61 welded or otherwise fixedly secured to the blade 51 as indicated at 62 (FIG. 8). The blades 60L, 60R are mounted on either side of the handle receptacle 41 and are maintained in an inactive plane generally parallel to, or in the same plane as, the plane of the blade 51 by means of a bolt 64 which passes over the handle receptacle and is secured in a pair of L-shaped flanges 65, 66 respectively mounted on the inner ends of blades 60L, 60R by threaded fasteners 68. A second pair of L-shaped flanges 69, 70 are respectively mounted on the outer ends of pivotal blades 60L, 60R by means of threaded fasteners 71. The rear-most edges of the pivotal blades 60L, 60R are provided with up-turned angular flanges 72L, 72R as best illustrated in FIG. 9. During operation of the snow removing tool shown in FIGS. 7–9, as the operator pushes the tool upwardly over the roof on wheels 24, the blades 51, 56, 58 serve to cut a U-shaped channel through the snow, while the pivotal blades 60L, 60R remain in the inactive position shown in the drawings with stop 64 resting on handle receptacle 41. When the tool 50 reaches its uppermost position on the roof and the operator begins to pull down on the handle 22, interaction between the snow in the U-shaped channel and the upturned flanges 72L, 72R causes the pivotal blades 60L, 60R to pivot about mounting rod 61 in a counterclockwise direction as viewed in FIG. 9 until the forward edges of the L-shaped flanges 65, 66, 69 and 70 engage the upper surface of blade 51, at which point the blades 60L, 60R are generally vertical to the blade 51 and to the roof surface. Continued downward movement of the tool 50 causes the blades 60L, 60R to propel the snow within the U-shaped channel previously formed downwardly in two sections which fall off the roof on either side of the handle 22 and in a direction diagonally away from the operator.

Figure 10:
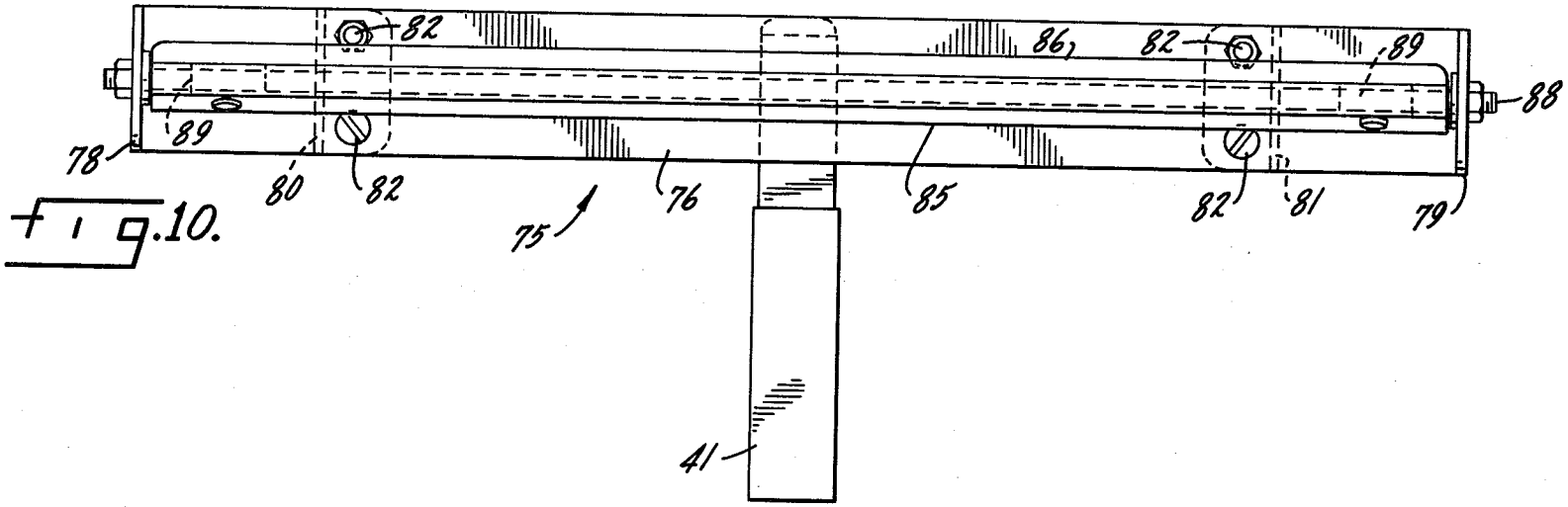
Figure 11:
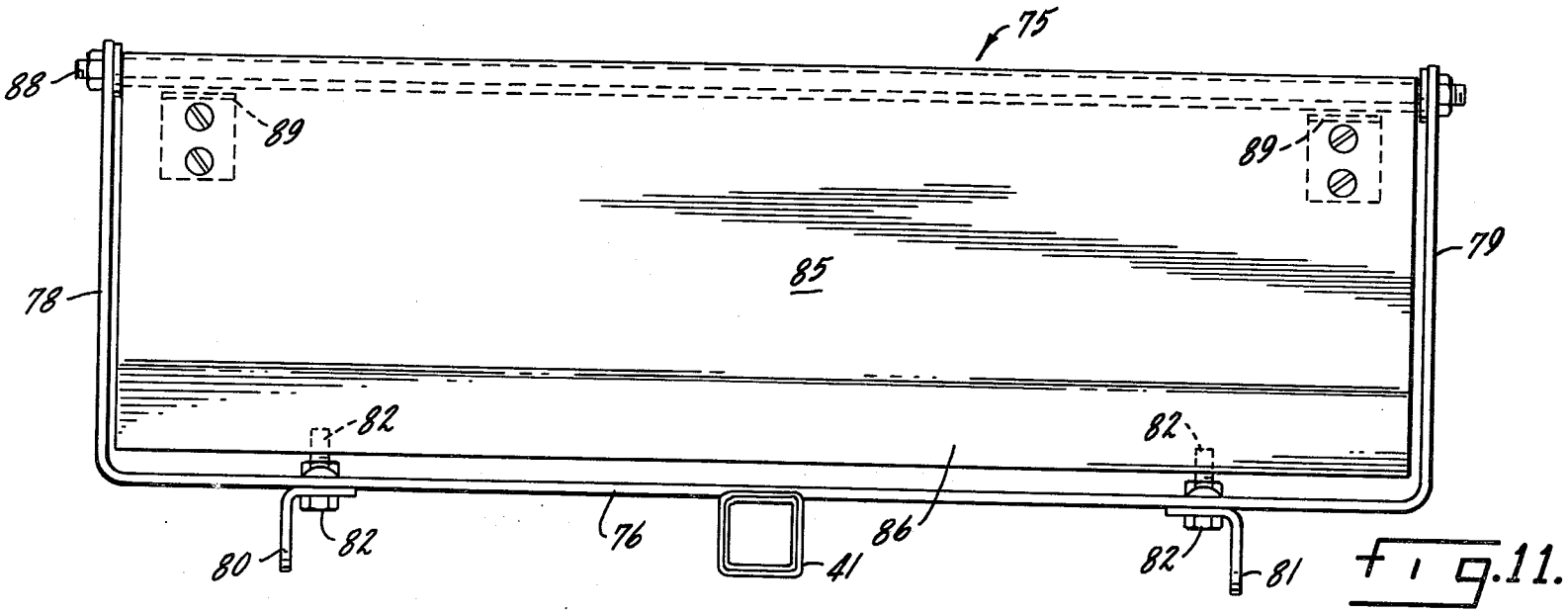

Referring to FIGS. 10, 11 and 12 conjointly, yet another modification of a snow removing tool, generally indicated at 75, has been illustrated, such tool also embodying the features of the present invention. In this form of the invention, the handle receptacle 41 is welded or fixedly secured to the bottom surface of a relatively thin blade 76 having vertically upstanding end flanges 78, 79. A pair of laterally spaced skids 80, 81 are secured to the underside of blade 76 by any suitable means—e.g., bolts 82. The skids have rounded corners as best indicated at 84 in FIG. 12 to facilitate movement over the exposed edges of roofing shingles and tiles. A pivotal blade 85 having an angular flange 80 at its lower free edge is pivotally secured at its upper edge to a support rod 88 mounted at its opposite ends in the upper ends of flanges 78, 79. The pivotal blade 85 is locked in position on support rod 88 with freedom for pivotal movement thereabout by means of a pair of spaced locking flanges 89 bolted or otherwise affixed to the blade 85. In keeping with this form of the invention, the bolts 82 which are utilized to secure the skids 80, 81 to blade 76 extend upwardly above the surface of blade 76 and define stops which prevent clockwise pivotal movement of blade 85 beyond the position shown in FIG. 12 as a result of engagement of the angular blade flange 86 with bolts 82. As with the forms of the invention previously described, blade 76 and its upstanding end flanges 78, 79 define a U-shaped body member suitable for cutting a U-shaped channel through snow accumulations.

When removing snow utilizing the tool 75, the tool is again pushed upwardly over the surface of the roof by the operator with the skids 80, 81 sliding over the surface of the roof. The blade 76 with its upstanding flanges 78, 79 serves to cut a U-shaped channel through the snow, while the mass of snow forward of the tool causes the pivotal blade 85 to pivot about rod 88 in a counterclockwise direction as viewed in FIG. 12 with the blade 85 assuming a position generally parallel to the plane of the roof or, in cases of light snow accumulation, the blade 85 rides on the upper surface of the snow. When the operator reverses the direction of the tool by pulling downwardly on handle 22, the angled flange 86 on pivotal blade 85 digs into the snow in the U-shaped channel previously formed, causing the blade 85 to pivot in a clockwise direction as viewed in FIG. 12 until the angular flange 86 engages the bolts 82, at which point the blade 85 is vertically oriented with respect to the roof and serves to plow the snow in the U-shaped channel previously formed downwardly off the roof.

Yet another modified snow removal tool 90 has been depicted in FIGS. 13–15, such tool also embodying the features of the present invention. In this embodiment, the tool 90 employs a relatively narrow blade with upstanding end flanges 52, 54 and integral vertical blades 56, 58 respectively secured thereto in a manner identical to that previously described in connection with the tool shown in FIGS. 7–9. As in that embodiment, a pair of wheels 24 are mounted in bearings 35 in side flanges 52, 54. In this instance, however, a handle receptacle 41 is rigidly secured between a pair of upstanding L-shaped flanges 91 mounted on blade 51 by means of a pair of threaded fasteners 92. A pivotal unitary blade 60 is pivotally mounted on rod 61 in a manner identical to that previously described for blades 60L. 60R depicted in FIGS. 7–9, the blade 60 being provided with an upturned flange 72 (best illustrated in FIG. 15) at its rearmost free edge. A pair of flanged skids 94 having rounded corners to facilitate sliding motion over the exposed edges of roof shingles and similar roofing materials are fixedly secured to the lower surface of blade 60 adjacent the opposite ends thereof.

When tool 90 is utilized to remove snow from a pitched roof, as it is pushed upwardly over the roof by the operator the tool moves over the roof on wheels 24 while blades 51, 56, 58 serve to cut a U-shaped channel through the snow. Pivotal blade 60 remains generally parallel to the roof (i.e., in the position shown in FIG. 15) with skids 94 sliding over the roof surface. When the operator reverses the direction of tool movement by pulling downwardly on handle 22, the upturned flange 72 on pivotal blade 60 interacts with the snow within the U-shaped channel previously cut to force the blade 60 to pivot upwardly (counterclockwise as viewed in FIG. 15) until flange 72 engages the flanges 91, at which point further pivotal movement is precluded and the blade 60 is maintained in a generally vertical position because of co-action with the snow. Continued downward movement of tool 90 over the roof serves to plow the snow within the U-shaped channel previously formed off the roof.

In some instances, the pitched roofs of buildings are formed of relatively thick shingles, tiles, slate or similar materials wherein the leading or exposed edge of the roofing element may range up to on the order of one inch in thickness, thereby presenting an impediment to smooth upward traversal over the roof surface of a remotely operated handheld tool. In such instances, any of the forms of tools herein described may be provided with elongate skids of the type generally indicated at 98 in FIG. 16. Such skids are preferably bolted to the side flanges 52, 54 of the particular tool being utilized in lieu of the wheels 24 heretofore described, and are preferably dimensioned such that the skids will span at least two vertically spaced exposed leading edges of the roofing material utilized. As indicated in FIG. 16, the leading and trailing edges of the skids are rounded to facilitate movement of the tool over the roof surface. The arrangement is such that the skids 98 may be affixed to the tool so that they are parallel to the tool handle or, alternatively, by adjustment of the bolt and slot arrangement generally indicated at 99 in FIG. 16, so that they are at a slight angle to the handle, thereby further facilitating movement of the tool over the roof.

It will be appreciated that there have herein been described various embodiments of a portable tool which are particularly suitable for rapidly, effectively and safely removing snow from pitched roofs by an operator located on the ground. Because of this arrangement, the danger of an individual falling from a roof or causing damage to the roof while walking thereon are eliminated. The various tools can be made from a wide variety of light-weight, rigid commercially available materials such, merely by way of example, as plastic, fiberglass, aluminum, or the like.

Moreover, the tool described can also be used on multi-story buildings under certain conditions. For example, in split level buildings and in those instances where a two-story building has a one-story adjunct such as a covered porch or garage, the operator can stand on the lower level roof while clearing snow from the upper level roof. It is even possible for the operator to utilize the tools of the present invention on multi-story buildings by climbing to the peak of the roof and straddling the roof ridge line. Under these circumstances, the tool should be reversed with respect to handle 22 so that the pivotal blade member is parallel to the roof as the tool is pulled upwardly toward the rigid line, and pivots to an operating position as the tool is pushed downwardly from the ridge line. While this type of operation is inherantly more dangerous because the operator is located on the top of a snow covered pitched roof, it is nevertheless less dangerous than walking on the slippery surface of the roof while trying to manipulate a shovel since, in this use of the invention, the operator is straddling the roof ridge line.

And, of course, while tools embodying the invention have been particularly designed for usage on pitched roofs, they can also be utilized on flat roofs provided there is no roof curb which prevents the tool from propelling the snow over the edge of the roof.

I claim as my invention:

1. A portable tool for removing snow accumulations from the roofs of buildings comprising, in combination, a U-shaped body member having a horizontal bottom portion and two upstanding side flanges, roof engaging means mounted on said body member, handle means pivotally secured to said body member at a point centrally of said two upstanding side flanges and above said horizontal bottom portion for moving said tool upwardly and downwardly over the surface of said roof, first stop means mounted on said body member for engaging said handle means during movement of said tool upwardly over the roof for maintaining said horizontal bottom portion generally parallel to the roof during upward movement of said tool over the roof, said horizontal bottom portion and said two upstanding side flanges defining a U-shaped cutting edge for cutting a U-shaped channel in accumulated snow on the roof as said tool is moved upwardly over the roof, and second stop means mounted on said body member for engaging said handle means during movement of said tool downwardly over the roof and towards the roof edge for permitting said horizontal bottom portion of said U-shaped body member to pivot relative to said handle means into a position generally perpendicular to the roof during downward movement of said tool over the roof whereby said pivoted horizontal bottom portion plows the accumulated snow within the U-shaped channel off of the roof as said tool is moved downwardly by said handle means.

2. A portable tool for removing snow accumulations from the roofs of buildings comprising, in combination, a U-shaped body member, roof engaging means mounted on said body member, handle means rigidly secured to said body member for moving said tool upwardly and downwardly over the surface of the roof, said U-shaped body member having a horizontal bottom portion and two upstanding side flanges, said horizontal bottom portion defining a fixed blade having a cutting edge, and a flat blade pivotally secured to said body member and positioned so as to be generally parallel to the roof during movement of said tool upwardly over the surface of the roof, said flat blade having a flange formed along its trailing edge and turned out of the plane of said flat blade whereby said flat blade is maintained generally parallel to the plane of the roof during upward movement of said tool toward the roof ridge line while, during downward movement of said tool toward the roof edge, said flange co-acts with the accumulated snow on the roof to cause said flat blade to pivot into a generally vertical position with respect to the roof so as to plow accumulated snow in the path of movement of said pivoted flat blade off the roof as said tool moves downwardly.

3. A portable tool for removing snow accumulations from the roofs of buildings as set forth in claim 1 or 2 wherein said roof engaging means comprise wheels.

4. A portable tool for removing snow accumulations from the roofs of buildings as set forth in claims 1 or 2 wherein said roof engaging means comprise skids dimensioned to span at least two spaced exposed leading edges of shingled roofing materials.

5. A portable tool for removing snow accumulations from the roofs of buildings comprising, in combination, a U-shaped body member, roof engaging means mounted on said body member, handle means rigidly secured to said body member for moving said tool upwardly and downwardly over the surface of the roof, said U-shaped body member having a horizontal bottom portion and two upstanding side flanges, said horizontal bottom portion defining a fixed blade having a cutting edge, and a flat blade pivotally secured to said body member so as to be generally parallel to the roof during movement of said tool upwardly over the surface of the roof, said flat blade having an upturned flange along its trailing edge whereby said flat blade is maintained generally parallel to the plane of the roof during upward movement of said tool toward the roof ridge line while, during downward movement of said tool toward the roof edge, said upturned flange co-acts with the accumulated snow on the roof to cause said flat blade to pivot upwardly into a generally vertical position with respect to the roof so as to plow accumulated snow in the path of movement of said upwardly pivoted flat blade off the roof as said tool moves downwardly.

6. A portable tool for removing snow accumulations from the roofs of buildings comprising, in combination, a U-shaped body member, roof engaging means mounted on said body member, handle means rigidly secured to said body member for moving said tool upwardly and downwardly over the surface of the roof, said U-shaped body member having a horizontal bottom portion and two upstanding side flanges, said horizontal bottom portion defining a fixed blade having a cutting edge, and a flat blade pivotally secured to the upper portions of said two upstanding side flanges and positioned so as to be generally parallel to the roof during movement of said tool upwardly over the surface of the roof, said flat blade having a downturned flange along its trailing edge whereby said flat blade is maintained generally parallel to the plane of the roof during upward movement of said tool toward the roof ridge line while, during downward movement of said tool toward the roof edge, said downturned flange co-acts with the accumulated snow on the roof to cause said flat blade to pivot downwardly into a generally vertical position with respect to the roof so as to plow accumulated snow in the path of movement of said downwardly pivoted flat blade off the roof as said tool moves downwardly.

* * * * *